US005469022A

United States Patent [19]

Begum et al.

[11] Patent Number: 5,469,022

[45] Date of Patent: Nov. 21, 1995

[54] EXTENDED INTERACTION OUTPUT CIRCUIT USING MODIFIED DISK-LOADED WAVEGUIDE

[75] Inventors: Syeda R. Begum, Sunnyvale; Robert S. Symons, Los Altos, both of Calif.

[73] Assignee: Litton Systems, Inc., Beverly Hills, Calif.

[21] Appl. No.: 99,746

[22] Filed: Jul. 30, 1993

[51] Int. Cl.[6] ..... H01J 23/40

[52] U.S. Cl. ..... 315/5.39; 315/39; 333/212

[58] Field of Search ..... 315/5.39, 5.51, 315/39; 333/212

[56] References Cited

U.S. PATENT DOCUMENTS

| | | | |
|---|---|---|---|
| 3,447,019 | 5/1969 | Romiguiere | 315/39 X |
| 4,496,876 | 1/1985 | Young | 315/4 |
| 4,931,695 | 6/1990 | Symons | 315/5.39 |
| 5,304,942 | 4/1994 | Symons et al. | 315/5.39 X |

OTHER PUBLICATIONS

"The Theory of Disk–Loaded Wave Guides" by E. L. Chu and W. W. Hansen, Journal of Applied Physics, vol. 18, Nov. 1947, pp.: 996–1008.

"The Design of High–Power Traveling–Wave Tubes" by M. Chodorow and E. J. Nalos, Proceedings of the IRE, May 1956, pp.: 649–659.

*Primary Examiner*—Benny T. Lee
*Attorney, Agent, or Firm*—Graham & James

[57] ABSTRACT

An extended interaction output circuit is provided for interacting with a modulated electron beam and for outputting RF electromagnetic energy. The circuit comprises a plurality of linearly disposed cavities having an axially extending beam tunnel to permit the traveling therethrough of the modulated electron beam as well as to couple electromagnetic energy between the successive cavities. Each of the cavities is separated by an annular disk having a hole providing the axial beam tunnel. The hole diameters increase in steps so that the impedance of the successive cavities decreases along the axial extent of the circuit. The diameter of the successive cavities is also increased as the associated width is decreased to maintain the same mid-band resonant frequency. The linearly disposed cavities act as an RF filter having successively tapered impedances to reduce reflections of the electromagnetic energy propagating through the circuit. The gap-to-gap distance between successive cavities is selected to provide a 90 degree phase shift of the beam in order to maintain synchronous operation between the beam and the wave at the mid band frequency.

25 Claims, 2 Drawing Sheets

FIG. 4
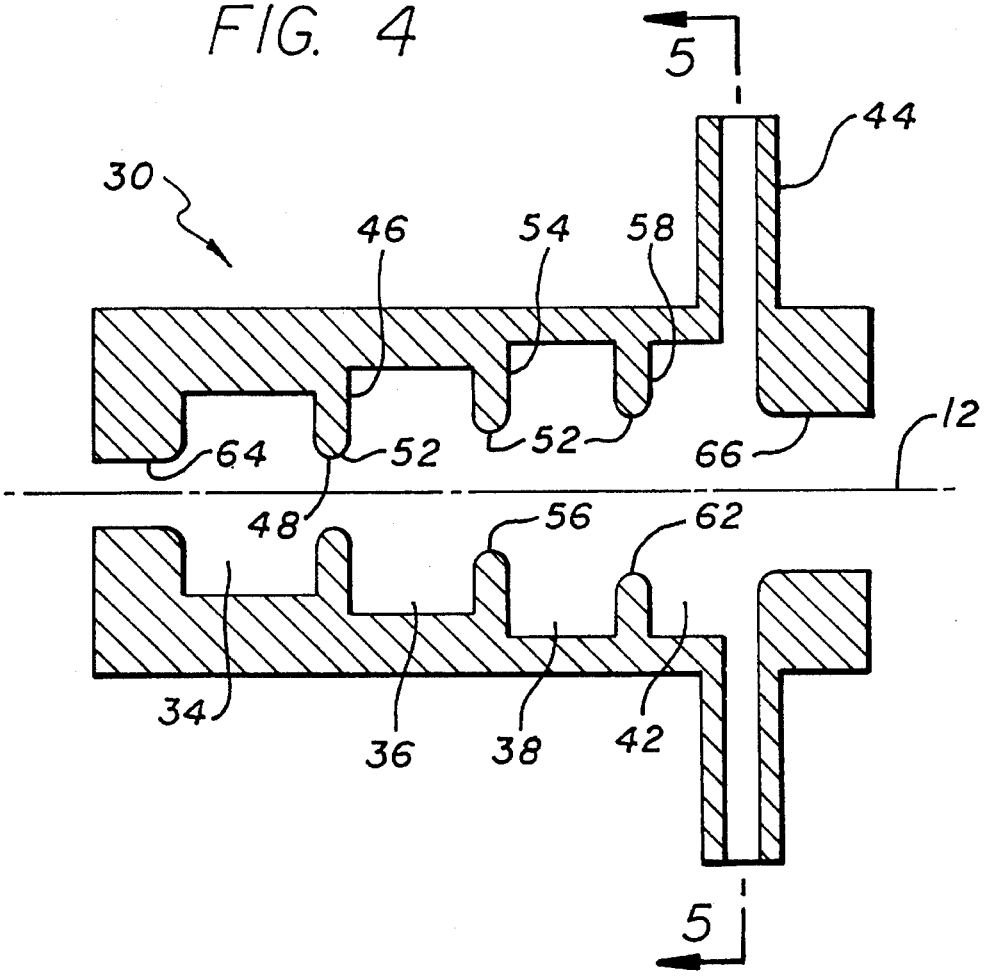
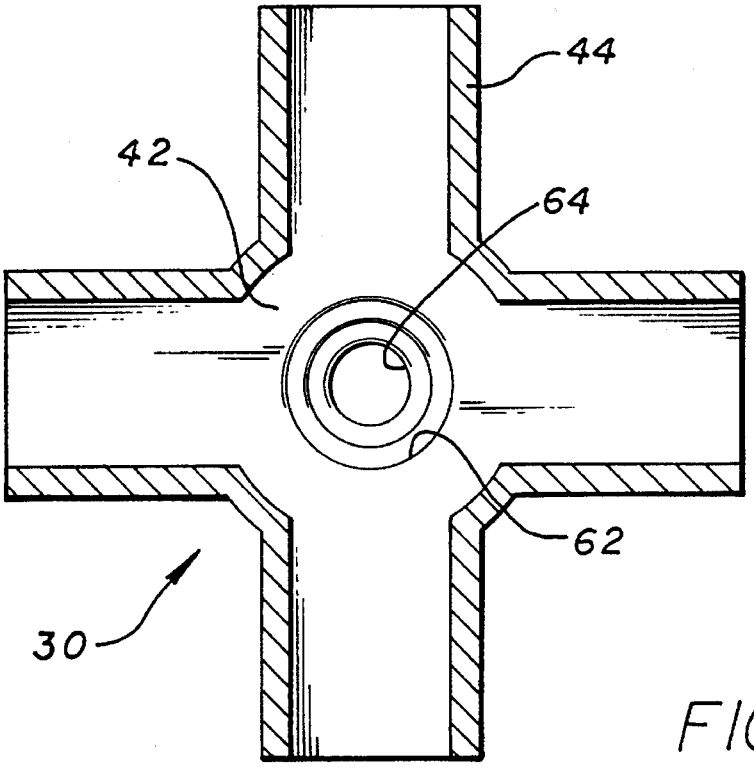
FIG. 5

EXTENDED INTERACTION OUTPUT CIRCUIT USING MODIFIED DISK-LOADED WAVEGUIDE

GOVERNMENT CONTRACT

This invention has been developed and reduced to practice under contract with the United States Government, Contract No. DAAH-01-90-C-A013, which has a license to practice the invention.

BACKGROUND OF THE INVENTION

1. Field of the Invention

The present invention relates to output circuits for extracting electromagnetic energy from a bunched electron beam, and more particularly, to a novel extended interaction output circuit of a relativistic klystron where the electromagnetic energy is extracted from a linear beam over a broad band of frequency.

2. Description of Related Art

Linear beam tubes are used in sophisticated communication and radar systems which require amplification of an RF or microwave electromagnetic signal. A conventional klystron is an example of a linear beam microwave amplifier. A klystron comprises a number of cavities divided into essentially three sections: an input section, a buncher section and an output section. An electron beam is sent through the klystron, and is velocity modulated by an RF electromagnetic input signal that is provided to the input section. In the buncher section, those electrons that have had their velocity increased gradually overtake the slower electrons, resulting in electron bunching. The traveling electron bunches represent an RF current in the electron beam. The RF current induces electromagnetic energy into the output section of the klystron as the bunched beam passes through the output cavity, and the electromagnetic energy is extracted from the klystron at the output section.

The development of high power klystron amplifiers which operate at a peak power level higher in relation to its pulse length and frequency than that of conventional klystrons has resulted in beam voltage levels generally higher than that previously achieved. To avoid RF breakdown in the output section due to the high beam voltage, multi-cavity output circuits were developed. The multi-cavity output circuits, known as extended interaction output circuits (EIOC), have the advantage that the electromagnetic energy can be removed from the electron beam at a reduced voltage across several gaps over a bandwidth which is greater by an amount that varies inversely with the output circuit impedance level. An example of a high performance extended interaction output circuit is disclosed in U.S. Pat. No. 4,931,695, which is incorporated herein by reference.

In order to achieve an efficient energy exchange between the electron beam and the output circuit, the electromagnetic wave that travels within the output circuit must synchronize with the beam with respect to the velocity of propagation. The '695 patent discloses the use of a multi-cavity extended interaction output circuit utilizing coupling irises to couple adjacent cavities. The dimensions and the locations of the irises can be selected to reduce the effective velocity of propagation of the electromagnetic wave in such a way that the phase velocity of the electromagnetic wave matches with that of the velocity modulated electron beam as it travels from one cavity gap center to the next cavity gap center.

However, conventional multi-cavity output circuits are inefficient when used with high power klystron amplifiers having relativistic electron beams. A relativistic electron beam travels much closer to the velocity of light than conventional klystron electron beams. In a conventional klystron, as in the '695 patent, the velocity of the electromagnetic wave is much slower than the velocity of light, and as the circuit is adjusted to increase the phase velocity, the bandwidth decreases.

Synchronization between the phase velocity of an electromagnetic wave and an accelerated beam at relativistic velocities has been previously demonstrated in association with disk-loaded waveguides. Disk-loaded waveguides are described in Chu and Hansen, *The Theory of Disk-Loaded Waveguides,* Journal of Applied Physics, volume 18, page 996 (1947). A disk-loaded waveguide has a sequence of cylindrical cavity resonators separated by disks having coupling holes. The disks are equidistant and the coupling hole diameters are the same for all disks, resulting in identical sequential cavities. The coupling holes permit the transmission of an accelerated beam through the waveguide. An equivalent filter network circuit for a fundamental disk-loaded waveguide is disclosed in Chodorow and Nalos, *The Design of High-Power Traveling-Wave Tubes,* Proceedings of the IRE 649 (May 1956).

In a disk-loaded waveguide, the introduction and selective placement of the disks permits the reduction of the phase velocity of the electromagnetic wave by as much as desired. As the holes in the disks are increased in size, the phase velocity first approaches and then exceeds that of light, and these characteristics are maintained over a fairly large bandwidth. Thus, disk-loaded waveguides are particularly applicable to the acceleration of electrons or protons in a linear accelerator.

Accordingly, it would be desirable to provide an output circuit for use with a relativistic klystron that provides the broad bandwidth characteristics of a multi-cavity extended interaction output circuit and the phase velocity synchronization characteristics of a disk-loaded waveguide. It would be further desirable to provide an output circuit having the above characteristics, while being relatively simple to design and cost effective to fabricate.

SUMMARY OF THE INVENTION

In accordance with the teachings of this invention, an extended interaction output circuit is provided for interacting with a modulated electron beam and for outputting RF electromagnetic energy. The output circuit comprises a plurality of linearly disposed cavities having an axially extending beam tunnel to permit the travelling therethrough of the modulated electron beam as well as to couple electromagnetic energy between the successive cavities. Each of the cavities are separated by an annular disk having a hole providing the axial beam tunnel. The hole diameter of the successive disks separating the cavities increases in steps so that the bandwidth of the successive cavities increases along the axial extent of the circuit, which in turn reduces the impedance of the successive cavities. Since increasing the diameter of the holes would increase the resonant frequency of the cavities, the diameter of the successive cavities is also increased in order to maintain the same mid-band resonant frequency. The width of the successive cavities is generally decreased to account for the slowing of the beam as it gives up energy to the circuit.

The linearly disposed cavities act as an RF filter having successively tapered impedances to reduce reflections of the electromagnetic energy propagating through the circuit. As the RF current increases through the circuit, the tapered impedances maintain the same potential at each cavity gap. For a circuit comprising N linear disposed cavities, the RF filter has an image impedance ($Z_1$) at the Nth cavity of $Z_1/N$. The gap-to-gap distance between successive cavities is selected to provide a 90-degree phase shift of the beam in order to maintain synchronous operation between the beam and the wave at the mid-band frequency.

More specifically, the extended interaction output circuit comprises a first linear cavity, a second linear cavity, a third linear cavity, and a fourth linear cavity. A first disk adjoins the first linear cavity and the second linear cavity, the first disk having a first hole for coupling the electromagnetic energy travelling between the first linear cavity and the second linear cavity. The second linear cavity has a diameter greater than and a width less than the first linear cavity. A second disk adjoins the second linear cavity with the third linear cavity, the second disk having a second hole for coupling the electromagnetic energy between the second and third linear cavities. The second hole has a diameter greater than that of the first hole. The third linear cavity has a diameter greater than and a width less than the second linear cavity. A third disk adjoins the third and fourth linear cavities, and has a third hole for coupling the electromagnetic energy between the third and fourth linear cavities. The third hole has a diameter greater than the second hole. The diameter and width of the fourth linear cavity is substantially the same as the diameter and width of the third linear cavity. RF energy is extracted from the fourth linear cavity through waveguide sections that are radially disposed from the fourth linear cavity. The first, second, and third holes also provide the tunnel for the modulated electron beam.

The first, second, third, and fourth linear cavities act as an RF filter network having first, second, and third image impedances and a load impedance. The second image impedance is approximately one-half of the first image impedance, the third image impedance is approximately one-third of the first image impedance, and the load impedance is approximately one-fourth of the first image impedance.

This invention further provides a method for interacting with a modulated electron beam and outputting RF electromagnetic energy. The method comprises the steps of focusing the modulated electron beam through a plurality of linearly disposed cavities having an axially extending beam tunnel, coupling the RF electromagnetic energy between successive ones of the cavities via the beam tunnel, and successively tapering impedances of the cavities to reduce reflections of the propagating RF electromagnetic energy. Adjacent ones of the cavities are separated by annular disks having a hole providing the beam tunnel. The diameter of the holes and of the cavities generally increases in steps along an axial extent thereof. Spacing between the adjacent ones of the cavities is selected by decreasing the width of the cavities in steps along the axial extent of the circuit to provide a 90 degree phase shift to the beam.

A more complete understanding of the extended interaction output circuit using a modified disk-loaded waveguide will be afforded to those skilled in the art, as well as a realization of additional advantages and objects thereof, by consideration of the following detailed description of the preferred embodiment. Reference will be made to the appended sheets of drawings which will be first described briefly.

BRIEF DESCRIPTION OF THE DRAWINGS

FIG. 4 is a cross-sectional side view of the extended interaction output circuit of the present invention; and FIG. 5 is a cross-sectional end view of the extended interaction output circuit showing RF output waveguides, as taken through the section 5—5 of FIG. 4.

DETAILED DESCRIPTION OF THE PREFERRED EMBODIMENT

The present invention provides an output circuit for a relativistic klystron providing both the broad bandwidth characteristics of a multi-cavity extended interaction output circuit and the phase velocity synchronization characteristics of a disk-loaded waveguide. Moreover, the output circuit has relatively simple construction and would be cost effective to manufacture over conventional multi-cavity output circuits.

Figure 2:
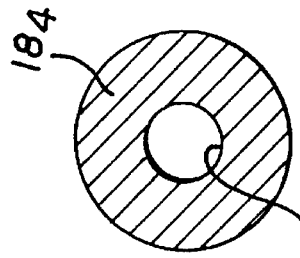
FIG. 2 PRIOR ART
FIG. 2 is a cross-sectional end view of a prior art coupling disk, as taken through the section 2—2 of FIG. 1.
Figure 1:
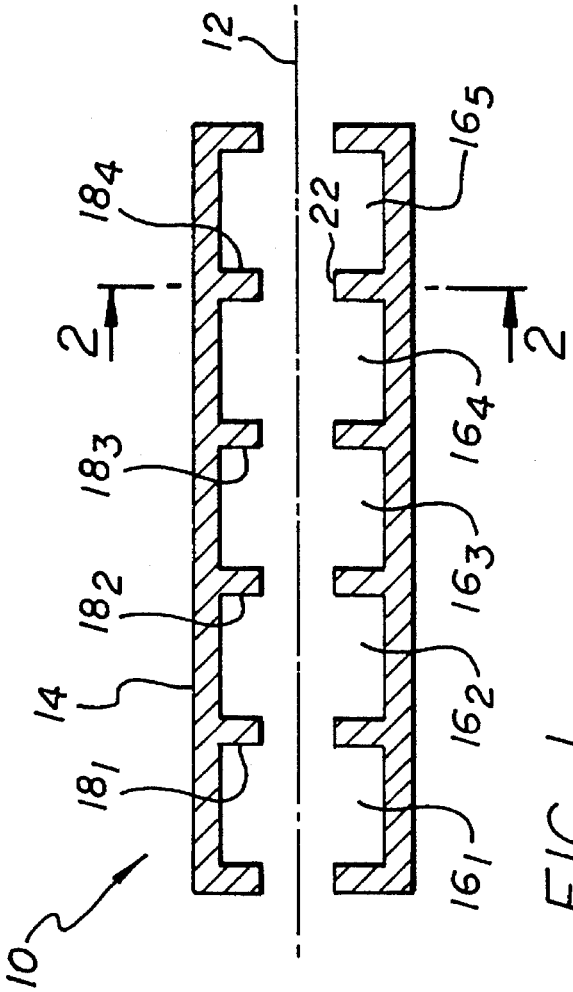
FIG. 1 PRIOR ART
FIG. 1 is a cross-sectional side view of a prior art disk-loaded waveguide output circuit.

Referring first to FIG. 1, a prior art disk-loaded waveguide 10 is illustrated. The waveguide 10 is disposed within a generally cylindrical outer sleeve 14, and features a plurality of linearly disposed cavities $\mathbf{16}_1$, $\mathbf{16}_2$, $\mathbf{16}_3$, $\mathbf{16}_4$ and $\mathbf{16}_5$ (hereinafter collectively designated as 16). Each adjacent pair of the cavities is separated by disks $\mathbf{18}_1$, $\mathbf{18}_2$, $\mathbf{18}_3$ and $\mathbf{18}_4$, respectively (hereinafter collectively designated as 18). As also illustrated in FIG. 2, the disks 18 (as designated by disk $\mathbf{18}_4$) each have a hole 22 at a central portion thereof which permits the transmission of an accelerated beam 12 therethrough. Each of the cavities 16 is generally cylindrical in shape and has substantially identical spacing and diameter. The holes 22 are of substantially the same diameter.

Disk-loaded waveguide circuits are used in linear accelerators in which an electric field is used to accelerate particles, such as electrons or protons. A disk-loaded waveguide permits the synchronization of the electromagnetic wave with the beam at relativistic velocities, and provides a simple structure which is easy to construct. Thus, the disk-loaded waveguide has been determined to be capable of modification to improve the phase velocity synchronization characteristics for klystron applications.

Referring now to FIGS. 4 and 5, an extended interaction output circuit 30 of the present invention is illustrated. The circuit 30 includes an entrance beam tunnel 64 (see FIG. 4) and an exit beam tunnel 66. A relativistic electron beam 12 (see FIG. 4) which has been velocity modulated is provided to the entrance beam tunnel 64, and the RF electromagnetic energy in the beam extracted by the output circuit 30. After passing through the output circuit 30, the spent electron beam leaves the output circuit 30 through the exit beam tunnel 66 and is deposited into a collector or beam dump (not shown).

As best seen in FIG. 4, the circuit 30 has four linearly disposed cavities 34, 36, 38, and 42. Each of the cavities is generally cylindrical shaped with generally increasing diameter and generally decreasing width along the axial extent of the circuit 30. The linear cavities are adjoined by a plurality of annular disks, including a first disk 46, a second disk 54 and a third disk 58. Each of the disks has a centrally disposed hole, including a first hole 48, a second hole 56 and a third hole 62, respectively. The diameters of the holes increase along the axial extent of the circuit 30. As the width of the cavities changes, the gap-to-gap distance between cavity centers also changes, with the largest gap-to-gap distance being between the first and second cavities 34 and 36, and the gap-to-gap distance generally decreasing for the remainder. The fourth cavity 42 has a plurality of output waveguides 44 which are generally rectangular in shape. The output waveguides 44 extend outwardly and are radially disposed at 90-degree intervals.

The cavities and disks can be formed of an electrically conductive material, such as copper. An ordinary machining processes, such as boring an initial cylindrical billet, can be used to fabricate the circuit 30. Each of the holes has generally rounded edges 52 to reduce the possibility of arcing resulting from high electric field intensity at sharp corners.

The holes 48, 56, and 62 provide a tunnel for the beam 12, and also enable the coupling of electromagnetic energy between the successive linear cavities. The increase in the size of the beam tunnel due to the increasing hole size results in increased coupling between the successive cavities, which in turn increases the bandwidth of the circuit 30 and decreases the impedance. With the increase of the hole diameter, the diameter of the successive cavities must be increased in order to maintain the same mid-band frequency. The third and fourth cavities 38 and 42 are identical in diameter in order to avoid mode trapping in the third cavity.

In operation, a bunched electron beam 12 excites the first cavity 34 and creates an electromagnetic field which produces an RF transverse magnetic (TM) wave which propagates through the first hole 48 into the second linear cavity 36. At the same time, the modulated electron beam 12 passes through the first hole 48 and into the second cavity 36. The RF electromagnetic wave propagates from the second cavity 36 into the third cavity 38 through the second hole 56. The electron beam 12 passes through the second cavity 36 into the third cavity 38, further reinforcing the RF wave. The RF wave then propagates into the fourth cavity 42 through the third hole 62. The electron beam 12 passes through the fourth cavity 42 and exits through the beam tunnel 66. The output waveguide sections 44 serve as an output transmission port for the amplified RF energy.

The gap-to-gap distance in the successive linear cavities is chosen such that the phase shift of the beam travelling through the circuit is the same as the change in phase of the RF wave moving through the cavities at the mid band frequency. In the preferred embodiment, the gap-to-gap distance is selected to provide a 90 degree phase shift to the beam at mid band to maintain synchronous operation between the beam and the wave. Since the beam slows as it passes from cavity to cavity and gives up energy to the circuit 30, the gap-to-gap distance is successively reduced by reducing the cavity width to maintain synchronization. Accordingly, the first cavity 34 has a maximum width of the four successive cavities, the second cavity 36 has a next largest width, and so on. The third cavity 38 and fourth cavity 42 of the circuit 30 have substantially the same width to avoid mode trapping in the third cavity 38, as discussed above.

Figure 3:
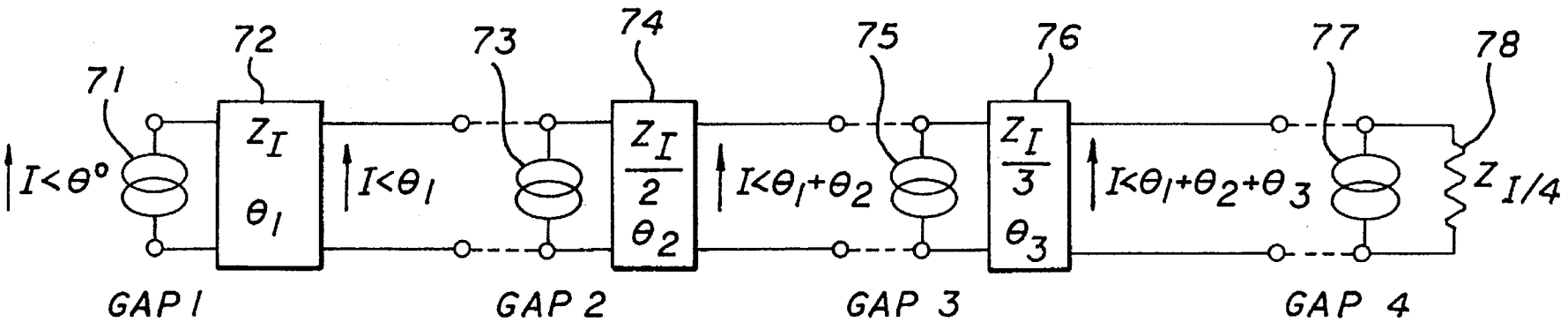
FIG. 3 is an electrical equivalent circuit of an extended interaction output circuit of the present invention.

In FIG. 3, an equivalent electrical circuit diagram of the extended interaction output circuit 30 is shown. The circuit diagram comprises a first current generator 71, a first filter circuit 72, a second current generator 73, a second filter circuit 74, a third current generator 75, a third filter circuit 76, a fourth current generator 77, and a first resistance 78. The current generators represent the modulated electron beam along the axis between each of the beam holes joining the linear cavities, which are represented in FIG. 3 as GAP1, GAP2, GAP3, and GAP4, respectively. Specifically, the first current generator 71 represents the modulated electron beam 12 at the center of the first linear cavity 34, the second current generator 73 represents the modulated electron beam at the center of the second linear cavity 36, the third current generator 75 represents the modulated electron beam 12 at the center of the third linear cavity 38, and the fourth current generator 77 represents the modulated electron beam 12 at the center of the fourth linear cavity 42.

The modulated beam is characterized in FIG. 3 as being a current vector ($\uparrow$I) having a phase angle ($\theta$). The phase of the modulated beam 12 shifts as it passes each of the successive linear cavities. The phase of the current generated by the first current generator 71 is therefore taken as a reference angle at zero degrees. The phase of the current generated by the second current generator 73 is $\theta_1$. The phase of the third current generator 75 is $\theta_1+\theta_2$. The phase of the fourth current generator 77 is $\theta_1+\theta_2+\theta_3$. Each of the linear cavities introduces an incremental phase shift (i.e., $\theta_1$, $\theta_2$, and $\theta_3$) which sums as the modulated beam travels between successive cavities. The magnitude of the incremental phase shift for each respective cavity $\theta_1$, $\theta_2$, $\theta_3$, is set to be equivalent to the respective image transfer constant $\theta_1$, $\theta_2$, $\theta_3$, in order to provide an adequate match between the modulated beam and the circuit.

The image impedance of the successive filters tapers in steps. The first filter circuit 72 has an image impedance $Z_1$ and an image transfer constant of $\theta_1$, which is the same as the difference in phase between the current generators 71 and 73. The second filter circuit 74 has an image impedance $Z_1/2$, and an image transfer constant of $\theta_2$, which is the same as the difference in phase between the current generators 73 and 75. The third filter circuit 76 has an image impedance $Z_1/3$ and an image transfer constant of $\theta_3$, which is the same as the difference in phase between the current generators 75 and 77. The resistance 78 has a resistance equal to $Z_1/4$. Thus, for an output circuit 30 having N cavities, the image impedance of the current generator representing the modulated electron beam at the center of the Nth cavity would be $Z_1/N$.

The first filter circuit 72 with the image impedance $Z_1$ incorporates the capacitance of the first linear cavity 34, the inductance of the first linear cavity 34, and a portion of the coupling capacitance through the first hole 48. The second filter circuit 74 with the image impedance $Z_1/2$ incorporates the capacitance of the second linear cavity 36, the inductance of the second linear cavity 36, the remaining portion of the coupling capacitance through the first hole 48, and a portion of the coupling capacitance through the second hole 56. The third filter circuit 76 with the image impedance $Z_1/3$ incorporates the capacitance of the third linear cavity 38, the inductance of the third linear cavity 38, the remaining portion of the coupling capacitance through the second hole 56, and the coupling capacitance through the third hole 62. The resistance $Z_1/4$ represents the resistive load of the waveguides 44.

The tapered impedance of the circuit 30 reduces reflections of the forward travelling wave propagating through the circuit 30. The reduced reflections result in a uniform electric field intensity along the beam tunnel and a linear growth of power maintained along the length of the circuit 30. Moreover, the decreasing impedance is achieved by increasing the bandwidth of the successive cavities which also helps to avoid mode trapping from higher order modes.

Having thus described a preferred embodiment of a novel extended interaction output circuit using a modified disk-loaded waveguide, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. For example, it should be apparent that a circuit having a greater number of cavities can be made in accordance with the teachings of the invention. The circuit would have generally tapering impedances due to the step increases in hole size of the disks separating the cavities. The diameter of the cavities would also increase in steps to maintain the mid-band resonant frequency of the circuit. The width of the cavities would decrease in steps to account for the slowing of the beam, and would be selected to provide a 90 degree phase shift to the beam.

The present invention is further defined by the following claims.

What is claimed is:

1. An extended interaction output circuit for interacting with a modulated electron beam and outputting RF electromagnetic energy, said circuit comprising:

a plurality of linearly disposed cavities being separated by disks having a single respective hole for transmission of said electron beam and for coupling said electromagnetic energy between said adjacent cavities;

wherein, said linearly disposed cavities act as an RF filter having successively tapered impedances to reduce reflections of said electromagnetic energy propagating through said circuit.

2. The circuit of claim 1, further comprising N of said linear disposed cavities where N is an integer which is greater than one, and said RF filter has an image impedance at a center of the Nth cavity of $Z_1/N$.

3. The circuit of claim 1, wherein said linear disposed cavities respectively have first, second and third image impedances and a load impedance associated therewith, said second image impedance being approximately one-half of said first image impedance, said third image impedance being approximately one-third of said first image impedance, and said load impedance being approximately one-fourth of said first image impedance.

4. The circuit of claim 1, wherein said holes of successive ones of said disks increase in size in steps along said circuit.

5. The circuit of claim 1, wherein said plurality of linearly disposed cavities respectively comprises a first cavity, a second cavity, a third cavity, and a fourth cavity, each of said cavities being cylindrically-shaped with respective diameters and widths, said second cavity having a diameter greater than that of said first cavity.

6. The circuit of claim 5, wherein said third cavity has a diameter greater than the diameter of said second cavity.

7. The circuit of claim 5, wherein said first cavity has a width greater than the width of said second cavity, and said second cavity has a width greater than the respective width of either one of said third or fourth cavities.

8. The circuit of claim 1, wherein each of said linearly disposed cavities introduces a corresponding 90 degree phase shift to said beam.

9. The circuit of claim 1, wherein there are four of said linearly disposed cavities.

10. An extended interaction output circuit for interacting with a modulated electron beam and for outputting RF electromagnetic energy, said circuit comprising:

a first cylindrically-shaped linear cavity having an associated diameter and width;

a second cylindrically-shaped linear cavity respectively having a diameter greater than and a width less than the diameter and width of said first linear cavity and a first disk adjoining said first and said second linear cavities, said first disk having a first hole permitting transmission of said electron beam between said first linear cavity and said second linear cavity;

a third cylindrically-shaped linear cavity respectively having a diameter greater than and a width less than the diameter and width of said second linear cavity and a second disk adjoining said second linear cavity and said third linear cavity, said second disk having a hole permitting transmission of said electron beam between said second linear cavity and said third linear cavity, said second hole having a size greater than said first hole; and a fourth cylindrically-shaped linear cavity having a third disk adjoining said third and fourth linear cavities, said third disk having a third hole having a size greater than said second hole;

wherein, said cavities act as an RF filter having successively tapered impedances.

11. The extended interaction output circuit of claim 10, wherein said RF filter has first, second and third image impedances and a load impedance, associated with said first, second, third and fourth linear cavities, respectively, said second image impedance being approximately one-half of said first image impedance, said third image impedance being approximately one-third of said first image impedance, and said load impedance being approximately one-fourth of said first image impedance.

12. The extended interaction output circuit of claim 10, further comprising an output section having radially disposed waveguides, said waveguides for extracting RF electromagnetic energy from said fourth linear cavity.

13. The extended interaction output circuit of claim 10, wherein each of said linear cavities introduces a corresponding 90 degree phase shift to said RF electromagnetic energy.

14. An extended interaction output circuit for interacting with a modulated electron beam and for outputting RF electromagnetic energy, said circuit comprising:

a plurality of linearly disposed cavities having an axially extending beam tunnel for permitting the traveling therethrough of said modulated electron beam and for coupling therethrough said electromagnetic energy between successive ones of said cavities; and a plurality of annular disks each having a single respective hole providing said beam tunnel, each of said disks respectively separating adjacent ones of said cavities;

wherein, relative proportional dimensions of successive ones of said holes and of successive ones of said cavities generally increases in steps along an axial extent of said circuit.

15. The extended interaction output circuit of claim 14, wherein said cavities each respectively comprise a width that decreases in steps along the axial extent of said circuit.

16. The extended interaction output circuit of claim 14, wherein said plurality of linearly disposed cavities comprises a first cavity, a second cavity, a third cavity, and a fourth cavity.

17. The extended interaction output circuit of claim 16, wherein said RF filter has first, second and third image impedances and a load impedance, associated with said first, second, third and fourth linear cavities, respectively, said second image impedance being approximately one-half of said first image impedance, said third image impedance being approximately one-third of said first image impedance, and said load impedance being approximately one-fourth of said first image impedance.

18. The extended interaction output circuit of claim 14, wherein said cavities act as an RF filter having successively tapered impedances for reducing reflections of RF electromagnetic energy propagating through said circuit.

19. The extended interaction output circuit of claim 18, further comprising N of said linear disposed cavities where N is an integer greater than one and said RF filter has an image impedance at the Nth cavity of $Z_1/N$.

20. The extended interaction output circuit of claim 14, wherein spacing between said adjacent ones of said cavities provides a corresponding 90 degree phase shift to said beam.

21. The extended interaction output circuit of claim 14, wherein there are four of said linearly disposed cavities.

22. A method for interacting with a modulated electron beam and outputting RF electromagnetic energy, said method comprising the steps of:

focusing said modulated electron beam through a plurality of linearly disposed cylindrically-shaped cavities via a beam tunnel axially extending therethrough, said cavities each having an associated diameter and width;

coupling said RF electromagnetic energy between successive ones of said cavities via said beam tunnel; and successively tapering impedances of said cavities to reduce reflections of said RF electromagnetic energy.

23. The method of claim 22 wherein said tapering step further comprises separating adjacent ones of said cavities by annular disks having a respective circular hole providing said beam tunnel, and successively increasing diameter of said holes and of said cavities in steps along an axial extent thereof.

24. The method of claim 23, wherein said tapering step further comprises selecting spacing between said adjacent ones of said cavities to provide a corresponding 90 degree phase shift to said beam.

25. The method of claim 23, wherein said tapering step further comprises decreasing said width of successive ones of said cavities in steps along an axial extent thereof.

* * * * *